US011382418B1

(12) United States Patent
Dettler et al.

(10) Patent No.: US 11,382,418 B1
(45) Date of Patent: Jul. 12, 2022

(54) SUSPENDABLE ERGONOMIC SPACE SAVING HEIGHT ADJUSTABLE ACTIVITY SUPPORT SURFACE

(71) Applicants: André Dettler, Brooklyn, NY (US); Valerie Pholpituke, Brooklyn, NY (US)

(72) Inventors: André Dettler, Brooklyn, NY (US); Valerie Pholpituke, Brooklyn, NY (US)

( * ) Notice: Subject to any disclaimer, the term of this patent is extended or adjusted under 35 U.S.C. 154(b) by 0 days.

(21) Appl. No.: 17/468,004

(22) Filed: Sep. 7, 2021

Related U.S. Application Data

(60) Provisional application No. 63/075,294, filed on Sep. 7, 2020.

(51) Int. Cl.
*A47B 5/04* (2006.01)
*A47B 9/12* (2006.01)
*A47B 5/02* (2006.01)

(52) U.S. Cl.
CPC ..... *A47B 5/04* (2013.01); *A47B 5/02* (2013.01); *A47B 9/12* (2013.01)

(58) Field of Classification Search
CPC .... A47B 5/00; A47B 5/04; A47B 5/02; A47B 9/12
USPC ..... 108/42
See application file for complete search history.

(56) References Cited

U.S. PATENT DOCUMENTS 3,799,072 A * 3/1974 Slaboden ..... A47B 43/00 108/107
4,187,787 A * 2/1980 Nakatsu ..... A47B 43/006 108/106
4,974,523 A * 12/1990 Giarratana ..... A47B 43/006 108/42
5,427,344 A * 6/1995 Beauchemin ..... A44B 11/125 108/149
6,116,164 A * 9/2000 Justen, Jr. ..... A47B 43/006 108/42

(Continued)

*Primary Examiner* — Daniel J Rohrhoff
(74) *Attorney, Agent, or Firm* — Timothy J. Bortree

(57) ABSTRACT

Disclosed is an activity support device including a body having at least one activity support surface, and at least one suspender integrated with the body and adapted to suspend the body from a support structure, wherein integration of the suspender with the body enables adjustment of an angle of the support surface relative to the support structure. In preferred embodiments, the suspender includes a support loop having a length and the loop is releasably secured to the body along the length. Preferably, the body can be released and resecured to the loop to enable adjustment of a position of the body relative to the loop, and adjusting the position changes the angle of the support surface relative to the support structure. Preferably, the body has an underside opposite the support surface, and the loop passes through a first through hole from the support surface to the underside and through a second through hole from the underside to the support surface. Further preferably, the body can be released and resecured to the loop at the underside by corresponding hook-and-loop features on the underside and the loop. Preferably, the suspender includes a suspension connector secured to the loop along the length, and the suspension connector is adapted to connect to the support structure.

20 Claims, 7 Drawing Sheets

(56) References Cited

U.S. PATENT DOCUMENTS

| | | | | |
|---|---|---|---|---|
| 6,119,615 | A * | 9/2000 | Porat | B63B 27/14 114/362 |
| 6,637,609 | B2 * | 10/2003 | Stevens | A47B 43/006 108/149 |
| 7,810,655 | B2 * | 10/2010 | Wang | A47B 43/006 211/118 |
| 8,356,720 | B2 * | 1/2013 | Mathews | A47B 45/00 211/90.02 |
| 8,444,101 | B2 * | 5/2013 | Holman | B65D 63/16 248/328 |
| 8,656,842 | B1 * | 2/2014 | McDonley | A47B 23/04 108/42 |
| 2012/0079664 | A1 * | 4/2012 | Civanelli | D06F 39/02 8/137 |
| 2012/0079965 | A1 * | 4/2012 | Gentry | A47B 5/00 108/42 |
| 2015/0320196 | A1 * | 11/2015 | Polizzi | A47B 5/06 320/101 |

* cited by examiner

LOCKED PIVOT ANGLED

SUSPENDABLE ERGONOMIC SPACE SAVING HEIGHT ADJUSTABLE ACTIVITY SUPPORT SURFACE

FIELD OF THE INVENTION

The present invention relates generally to portable furniture, and specifically to a suspendable, ergonomic, space saving, height adjustable work surface.

CROSS REFERENCE TO RELATED APPLICATION

The present application claims priority from the following U.S. Provisional Application, the entire disclosure of which is incorporated herein by reference: U.S. Provisional Application No. 63/075,294 (filed Sep. 7, 2020).

BACKGROUND OF THE INVENTION

In the common home, apartment or office there is often a need for an ergonomic, designated work space that is free of clutter and easily accessible. Many everyday tasks require the use of a clean and comfortable surface. One example is a work or study project that requires a laptop computer, books and notepads, using a desk that is free of unrelated items and can be set up in a quiet area or a more convenient location. Another example is the preparation of a meal using a cutting board that is clean and can be easily moved to an area of less congestion or to establish a more comfortable work position.

Because workplaces and needs are always changing, home and work environments ideally would be able to be easily adapted to accommodate a person's unique work habits. Therefore, a work surface that is clutter free and that can be easily set up and taken down as needed would be highly desirable.

There is a global trend toward a greater number of individuals working from home, and therefore a greater number of home offices that need to efficiently fit into existing living environments. A portable work surface that is simple to set up and take down can facilitate working in small spaces, and enable the completion of not only quick tasks but also longer, ergonomically supported work sessions, with minimal interference with the daily habits of a household and minimal impact to its space restrictions.

A problem with current portable desks is that their placement is limited to where their feet fit on the floor. They limit walking paths, create tripping hazards, and have mass, weight and support structures that require planning and claim valuable floor space real estate. Traditional work desks have a large footprint and cannot easily be stowed at the end of the day.

Current mobile office furniture is particularly frustrating for elderly persons that cannot move cumbersome heavy objects, and for parents with children in the home who need floor space for playing with toys. Available desks rely on legs for support and casters for mobility, and are therefore less than ideal, considering the increase in home office work and its impact on household activities.

Adjustable height work surfaces provide for multiple height settings and facilitate postures that improve blood flow throughout the body and accordingly are healthier for a person than those that necessitate a traditional desk sitting posture.

Accordingly, there is a need for an ergonomic, space saving work surface with height and angle adjustment and portability features. Such a device would facilitate a variety of work activities in different spaces, increasing efficiency and saving time.

SUMMARY OF THE INVENTION

The present invention provides an activity support device which addresses the above mentioned shortcomings by meeting the above described needs.

Preferred embodiments provide a suspendable, ergonomic, space saving, height adjustable work surface that includes the components and features described herein.

Envisioned as an example is a desk that can "float", or hang with its work surface oriented substantially perpendicular (or at any other desired operational angle) to the front or back surface of a door or window and be supported without legs in an orientation to function as a standing desk in compact rooms. It is contemplated that the hangable work surface can not only can be used in homes, offices, hospitals and other buildings, but also can be suspended from the inside or outside of vehicle doors and windows and other surfaces to serve as a remote work desk when the user is offsite or traveling.

Accordingly, the present invention in preferred embodiments provides an activity support device, including a body having at least one activity support surface (e.g., a desk surface), and at least one suspender integrated with the body and adapted to suspend the body from a support structure (e.g., a door). In preferred embodiments, integration of the suspender with the body enables adjustment of an angle of the support surface relative to the support structure.

In preferred embodiments, the suspender includes a support loop having a length, the loop being releasably secured to the body along the length. Preferably, the body can be released and resecured to the loop to enable adjustment of a position of the body relative to the loop, and adjusting the position changes the angle of the support surface relative to the support structure. Further preferably, the angle can be adjusted such that the support surface is substantially perpendicular to the support structure, and the angle can be adjusted such that the support surface is substantially parallel to the support structure.

Preferably, the body has at least two through holes and the loop passes through the holes to suspend the body by the loop. Further preferably, the body has an underside opposite the support surface, and the loop passes through a first through hole from the support surface to the underside and through a second through hole from the underside to the support surface. Still further preferably, the body can be released and resecured to the loop at the underside. Even further preferably, the body can be released and resecured to the loop at the underside by corresponding hook-and-loop features on the underside and the loop.

Preferably, the suspender includes a suspension connector secured to the loop along the length, the suspension connector adapted to connect to the support structure. Further preferably, the support structure is a door and the suspension connector includes a hook that hooks onto a top of the door.

In preferred embodiments, the suspender is adapted to enable adjustment of a suspension distance of the support surface relative to the support structure. Preferably, the suspender includes a suspension connector, a support strap, and a strap lock, the support strap having a strap length including a connection portion, an attachment portion and a locked portion, the connection portion being secured to the suspension connector, each of the attachment portion and the locked portion being secured to the strap lock to form a support loop between the attachment portion and the locked portion, the loop being integrated with the body. Further preferably, at least one of the attachment portion and the locked portion are releasably secured to the strap lock.

Further preferably, the loop has a loop length and the strap lock can be unlocked and relocked to enable adjustment of the loop length, and adjustment of the loop length adjusts the suspension distance.

Further preferably, the loop has a loop length and the loop is releasably secured to the body along the loop length. Still further preferably, the body can be released and resecured to the loop to enable adjustment of a position of the body relative to the loop, and adjusting the position changes the angle of the support surface relative to the support structure. Even further preferably, the angle can be adjusted such that the support surface is substantially perpendicular to the support structure, and the angle can be adjusted such that the support surface is substantially parallel to the support structure. Still further preferably, the body has at least two through holes and the loop passes through the holes to suspend the body by the loop.

In preferred embodiments, the activity support device further includes an accessory facilitation feature including one or more of a storage feature, a cable management feature, anti-slip features, a magnetic surface, and a coated surface adapted for eraseable writing. Preferably, the storage feature includes a pouch hanging from the loop below the body.

Additional features and embodiments of the present invention will be apparent from the following descriptions, drawings, and claims.

BRIEF DESCRIPTION OF THE FIGURES

The following example embodiments are representative of example techniques and structures designed to carry out the objects of the present invention, but the present invention is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DESCRIPTION OF PREFERRED EMBODIMENTS

Figure 1:
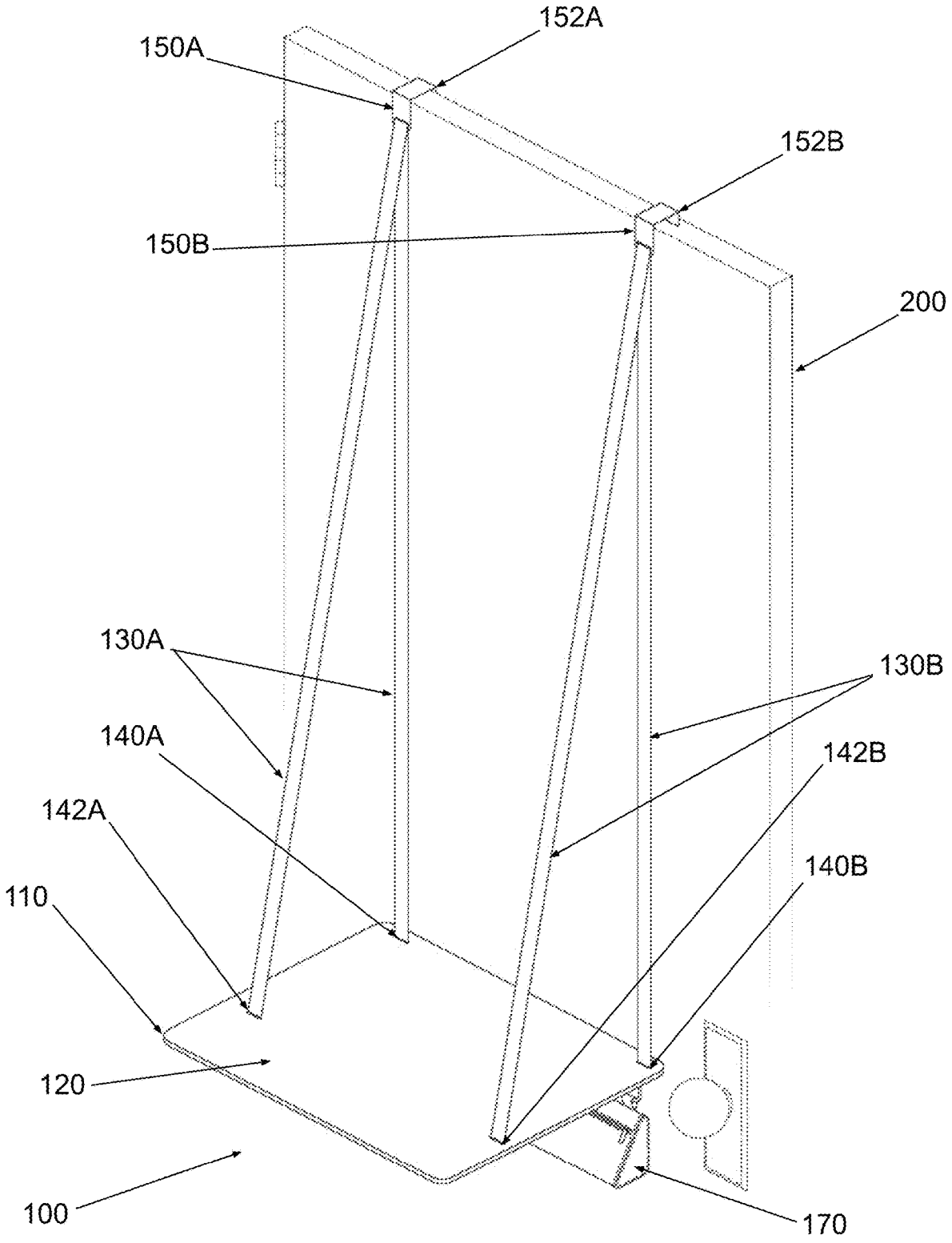
FIG. 1 is an illustration of an activity support device of a preferred embodiment of the present invention, showing the device suspended from a support surface at an operational angle.

Reference will now be made to preferred embodiments of the present invention, an example of which is illustrated in the accompanying drawings and pictures. Preferred embodiments are described herein in order to explain the present invention by referring to the figures.

The following description is provided to assist the reader in gaining a comprehensive understanding of the structures and methods described herein. Accordingly, various changes, modifications, and equivalents of the structures and methods described herein will be suggested to those of ordinary skill in the art. The progression of method operations described are merely examples, however, and the sequence type of operations is not limited to that set forth herein and may be changed as is known in the art, with the exception of operations necessarily occurring in a certain order. Also, descriptions of well-known functions and construction methods may be simplified and/or omitted for increased clarity and conciseness.

Numerous variations, modifications, and additional embodiments are possible, and accordingly, all such variations, modifications, and embodiments are to be regarded as being within the spirit and scope of the present invention. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity may be repeated, any activity may be performed by multiple entities, and/or any element may be duplicated. In addition, the sizes, shapes and configurations of the various structures and elements may vary in order to perform specific functions as necessary for a particular implementation.

The present invention provides an activity support device with a body with a support surface that can be suspended from a support surface and the angle of the support surface relative to the support structure can be adjusted.

The activity support device is discussed primarily as the support surface being a desk and the support structure being a door. However, it should be understood that the present invention encompasses a body of the device being any suitable or desired shape or configuration, including but not limited to those discussed herein. Further, it should be understood that the present invention encompasses a support surface being of any suitable or desired shape or configuration, including but not limited to those discussed herein. Still further, it should be understood that the present invention encompasses a support structure being any suitable structure, including but not limited to those discussed herein.

More particularly, and referring now to FIGS. 1-7 for illustration purposes as to certain example embodiments, the present invention in preferred embodiments provides an activity support device 100, including a body 110 having at least one activity support surface 120 (e.g., desk surface 120), and at least one suspender 130A,B integrated with the body 110 and adapted to suspend the body 110 from a support structure 200 (e.g., door 200). In preferred embodiments, integration of each suspender 130A,B with the body 110 enables adjustment of an angle of the support surface 120 relative to the support structure 200.

With regard to the body and the activity support surface of certain embodiments of the present invention, the body and/or the activity support surface can be made of any one or more suitable materials and be formed in any suitable shape. Preferably, the body and/or the activity support surface is made of wood that has been machined or laser cut to a desired shape. In other embodiments, the body and/or the activity support surface can be formed, additionally or alternatively, from other materials that are suited to specific uses. Non-limiting examples include metals such as, for example, stainless steel, preferably with an antimicrobial treatment or coating, that can be applied to or otherwise integrated into bodies and/or activity support surfaces that support food related or medical supply use or storage. Other non-limiting examples include plastics, which can be cleaned easily with spray cleaners and cloths and therefore are suitable for use as creative art project stations or as diaper changing tables. The body and/or the activity support surface can be transparent, partially transparent, or opaque.

The materials used for the body and/or the activity support surface can in some embodiments provide alternate or additional functionality. For example, the body and/or the activity support surface can be manufactured, formed and configured to function additionally or alternatively as a dry erase board, chalkboard, magnetic organizer board, cork board, or other functional surface. Unlike traditional desks that use only one primary surface for work, certain embodiments of the invention can utilize a top surface of the body as an activity support surface and an underside of the body as a second functional surface of the types listed above, or other types, due to the "flip-up" space saving feature of certain embodiments of the invention (e.g., positioning of the activity support surface parallel to the support structure, as desired for example herein).

The shape of the body and/or activity support surface is preferably rectangular (see, e.g., FIG. 1), but is not limited to a rectangular shape and can be shaped in a wide variety of circles, ovals, triangles, other geometric shapes, or any custom shape that suits desired uses or tasks.

The topography of the body and/or activity support surface preferably can include pockets, cut-outs, or other holes, recesses, or other features that allow for supplies or other items to be stored, when in use or not in use, in specific locations on the work surface and preferably be securely held in such locations when the work surface is being deployed, stowed and otherwise moved.

The body and/or activity support surface is preferably flat (see, e.g., FIG. 1), but bodies and/or activity support surfaces that are not flat are also contemplated. Preferably, the body and/or activity support surface can be featured to have, or be fitted with, anti-slip bars or similar devices or features that help or are otherwise useful to secure work objects (such as, for example, laptop computers) when the body and/or activity support surface is adjusted to desired ergonomic angles. In some embodiments, holes, extensions or other attachment features can be integrated with the body and/or activity support surface to allow for straps, hooks, pouches and other attachment devices to help or otherwise be useful to prevent work objects (such as, for example, laptop computers) from falling during movement of the body and/or activity support surface or use of the body and/or activity support surface at various angles. Storage pouches or other features or devices on or integrated with the body and/or activity support surface can be included also to hold accessories (such as, for example, phone and laptop chargers) or manage cables, cords and other loose or flexible work related items.

In some embodiments, additional materials or devices such as rubber pads, grips, adhesive stickers, and other attachment devices can be added to or integrated into the body and/or activity support surface or other parts of the device to create an ideal work space for certain tasks, enabling the securing of work objects related to specific uses, such as, for example, medical tests and devices, toys and craft items, and cables and supplies that are commonly found on desks in offices and need to be organized. In some embodiments, the body and/or activity support surface or other parts of the device can include damage prevention features (such as, for example, padding) to help prevent the development of marks on or damage to surrounding surfaces or objects (such as, for example, doors, walls, and windows) when the work surface is deployed, stowed or used.

Referring again to FIGS. 1-7 for illustration purposes as to certain example embodiments, in preferred embodiments, each suspender 130A,B includes at least one and preferably a plurality of support loops 130A,B, each having a length, each loop 130A,B being releasably secured to the body 110 along the length.

With regard to the suspenders of certain embodiments of the present invention, the body and/or activity support surface is preferably hung, suspended or otherwise supported or secured by one or more straps (see, e.g., FIG. 1). This preferably enables it to "float" at its location so as to minimize its impact to the space below it. However, any suitable manner of suspension, support or securing is contemplated by the invention, including the use of devices or features other than straps. In embodiments that use straps, the straps can be formed of any one or more suitable materials, such as, for example, fabric, plastic, nylon, rope, rubber or metal. The material is preferably suited for the work environment or type. For example, the straps, or all or other parts of the entire device, can be made from plastic, rubber or other waterproof material and accordingly be easily cleaned. In some embodiments, the entire device can be formed of materials that can be washed in a dishwashing machine.

In embodiments in which at least one strap is used, one or more straps (e.g., any number of straps) can be used. Preferably, the number of straps used for a configuration is the minimum number required to achieve the support requirements for the intended use of the work surface. Preferably, in certain embodiments, when the work surface is hung from the top of a door, wall, or window, two straps are used (see, e.g., FIG. 1). Preferably, in certain embodiments, when the body and/or activity support surface is supported by a horizontal strap configuration, a single strap that can tighten is sufficient to hold the body and/or activity support surface above the floor.

In preferred embodiments, the strap or other suspension, support or securing feature can be rolled up or otherwise made compact, whether manually or automatically, which increases the ease of transporting the device from one location to another. In some embodiments, the device includes a handle or other carrying feature that, for example, enables the device to be more easily carried as one would carry, for example, a suitcase, briefcase, messenger bag, or the like.

In preferred embodiments, the strap is constructed or otherwise configured with a surface that allows for Post-It notes, magnets, lights or other accessories to be attached to the strap, because the strap can, in some of such embodiments, serve as a vertical extension of the body and/or activity support surface. In certain embodiments, the strap can be configured in a substantially vertical orientation to hang the body and/or activity support surface in a substantially horizontal orientation. However, the body and/or activity support surface preferably can be suspended, supported or secured in other orientations as well. In certain embodiments, the strap can be oriented, and function, horizontally. For example, in some of such embodiments, the strap can be horizontally secured to a door in a horizontal loop. Such embodiments and others can be suitable for scenarios in which access to a top of a door is not available or additional attachment solutions are required or desired.

Preferably, the straps reduce or eliminate the need for table legs, feet, and casters, and accordingly enable the device to better protect, or prevent damage to, floors and chair legs.

Preferably, the strap is not only a feature that provides a primary mechanism for easy attachment to various types of doors, walls, windows, and other building or vehicle features, but also is a feature that provides a primary mechanism for adjustment of the angle and height of the work surface to accommodate various heights and orientations suitable for persons of any size and different work requirements (see, e.g., FIGS. 4-7).

Figure 2:
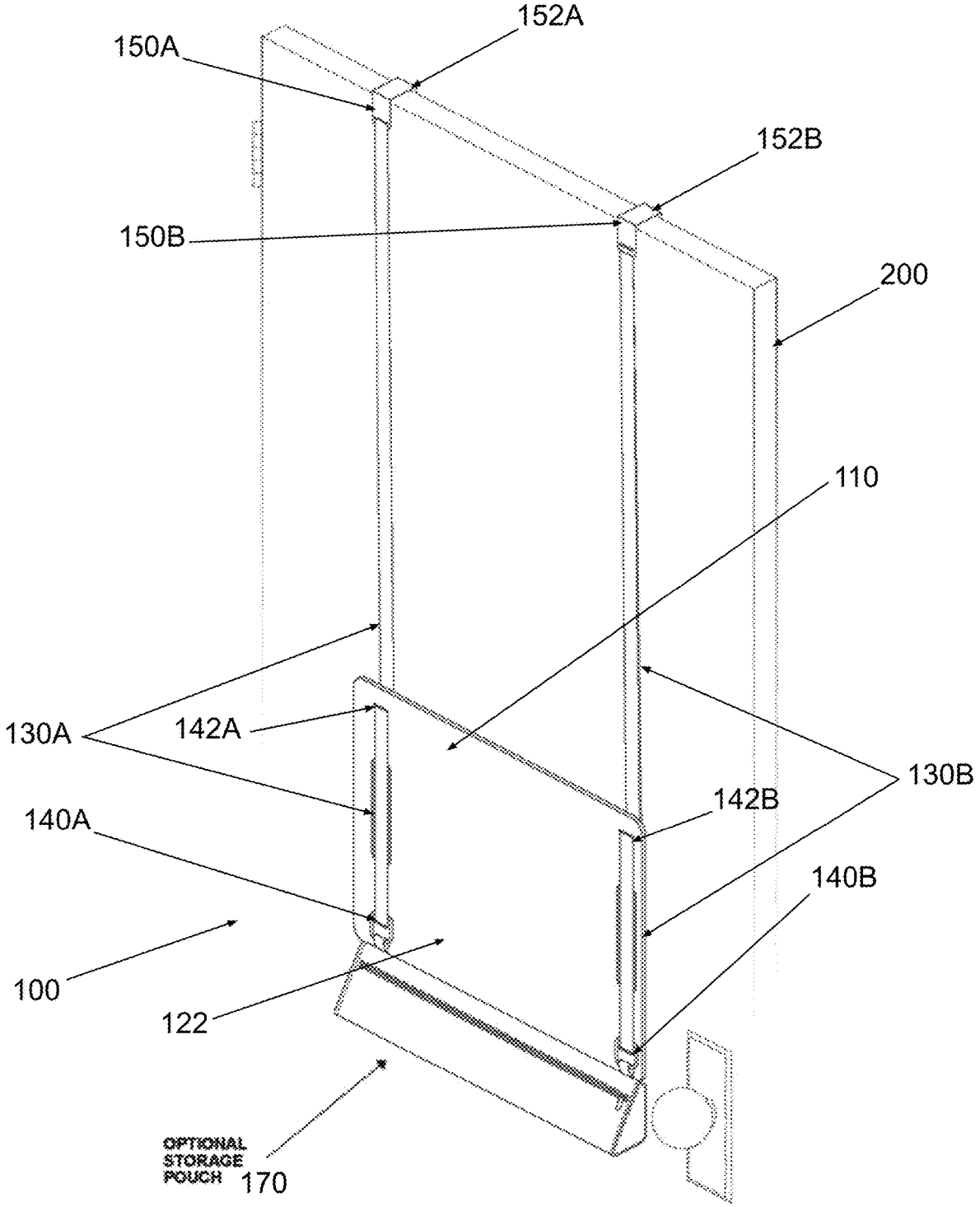
FIG. 2 is an illustration of an activity support device of a preferred embodiment of the present invention, showing the device suspended from a support surface at a stowed angle.

Referring again to FIGS. 1-7 for illustration purposes as to certain example embodiments, preferably, the body 110 can be released and resecured to each loop 130A,B to enable adjustment of a position of the body 110 relative to the loop 130A,B, and adjusting the position changes the angle of the support surface 120 relative to the support structure 200. Further preferably, the angle can be adjusted such that the support surface 120 is substantially perpendicular to the support structure 200 (e.g., as illustrated in FIG. 1) to place the support surface 120 at an operational angle. Further preferably, the angle can be adjusted such that the support surface 120 is substantially parallel to the support structure 200 (e.g., as illustrated in FIG. 2) to place the support surface 120 at a storage angle.

With regard to the integration of the body 110 with each suspender 130A,B and each suspender 130A,B being adapted to suspend the body 110, preferably, the body 110 has at least two through holes 140A,B,142A,B and each loop 130A,B passes through a respective pair of the holes 140A, 142A;140B,142B to suspend the body 110 by the loops 130A,B. Further preferably, the body 110 has an underside 122 opposite the support surface 120, and each loop 130A,B passes through a respective first through hole 140A,B from the support surface 120 to the underside 122 and through a respective second through hole 142A,B from the underside 122 to the support surface 120. Still further preferably, the body 110 can be released and resecured to each loop 130A,B at the underside 122 (e.g., by corresponding hook-and-loop features (e.g., Velcro) 180A,B; 182A,B on the underside 122 and the loop 130A,B.

In preferred embodiments, the device includes one or more such or other leveling features. Preferably, the leveling feature enables setting the angle of the body and/or activity support surface to any angle that is desirable for the work. Adjustment of the body and/or activity support surface preferably provides ergonomic advantages, such as, for example, by facilitating multiple postures throughout a long work day, which is beneficial for reducing fatigue and related physical stress. Adjustment of the body and/or activity support surface preferably also provides functional advantages, such as, for example, by enabling the angling of the body and/or activity support surface to present a laptop screen at a better viewing angle. For example, nurses or other personnel in a hospital may angle the body and/or activity support surface to have information on a laptop screen be more easily viewed by others in a room, such as, for example, bedridden patients.

In preferred embodiments, the materials, mechanisms, or other features that provide the leveling functionality are configured to enable adjustments (e.g., by the user) while the body and/or activity support surface is secured (e.g., by the user). For example, in certain embodiments, as described above and elsewhere herein, hook-and-loop materials (e.g., Velcro) are positioned on the underside of the body so as to enable adjustments while the body and/or activity support surface is secured with two hands (see, e.g., FIGS. 2 and 4-7). More particularly, for example, in certain preferred embodiments (see, e.g., FIGS. 2 and 4-7) hook-and-loop (e.g., Velcro) components on an underside of the body can interlock with cooperating hook-and-loop (e.g., Velcro) components on the side of the strap that faces the underside of the body when the strap is positioned through slots in the body, to fix the strap to the underside of the body when the body and/or activity support surface is at a desired position. To release the strap from the underside of the body, the hook-and-loop components can be separated (e.g., by a force strong enough to pull the hooks and loops apart). When the strap is unlocked, it can be moved through the slots to adjust the height and/or orientation of the body and/or activity support surface. Then, when the body and/or activity support surface is at the new height and/or orientation, the strap can again be fixed, or locked, to the underside of the body by pressing the hook-and-loop components together.

In some of such embodiments, the risk of objects falling from the body and/or activity support surface is preferably greatly reduced. In certain embodiments, the placement of the components and features of the leveling mechanism takes into consideration all of the user's movements and coordinates them to prevent or resolve any slipping or other displacements. Preferably in such embodiments, it is intended and anticipated that both of the user's hands will be used to hold the body and/or activity support surface secure during any angle adjustment operation.

Referring again to FIGS. 1-7 for illustration purposes as to certain example embodiments, preferably, each suspender 130A,B includes a respective suspension connector 150A,B secured to each loop 130A,B along the length, each suspension connector 150A,B being adapted to connect to the support structure 200. Further preferably, the support structure 200 is a door 200 and each suspension connector 150A,B includes a hook 152A,B that hooks onto a top of the door 200.

That is, in preferred embodiments, the straps or other support features that suspend or otherwise support the body and/or activity support surface can be secured above the intended operational location of the work surface. For example, the straps or other support features can be secured or otherwise mounted at the top of a door, wall, ledge or window. Other locations can additionally or alternatively be used for securing the body and/or activity support surface.

Figure 3:
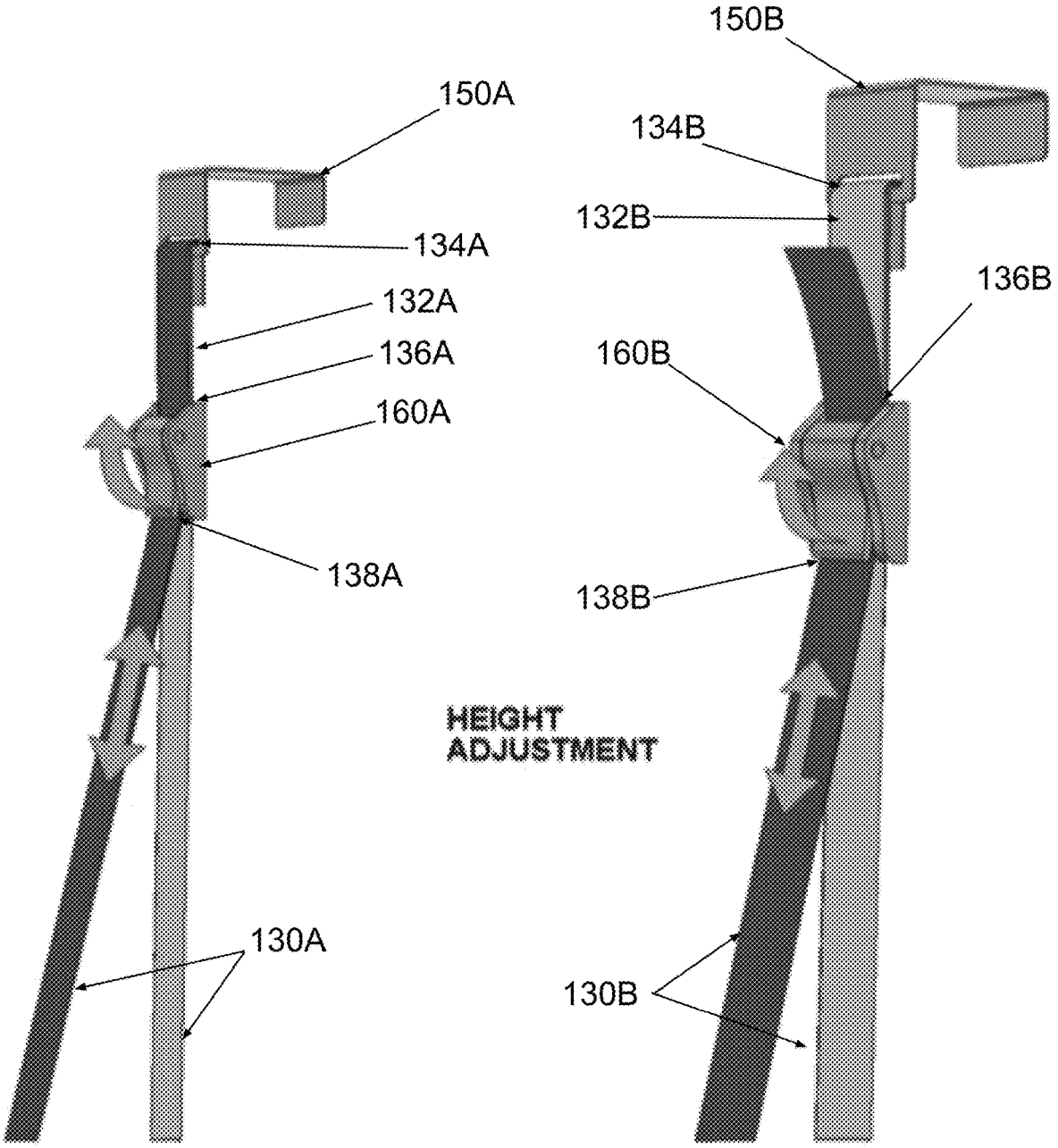
FIG. 3 is an illustration of a support loop, suspension connector and strap lock of an activity support device of a preferred embodiment of the present invention.
Figure 4:
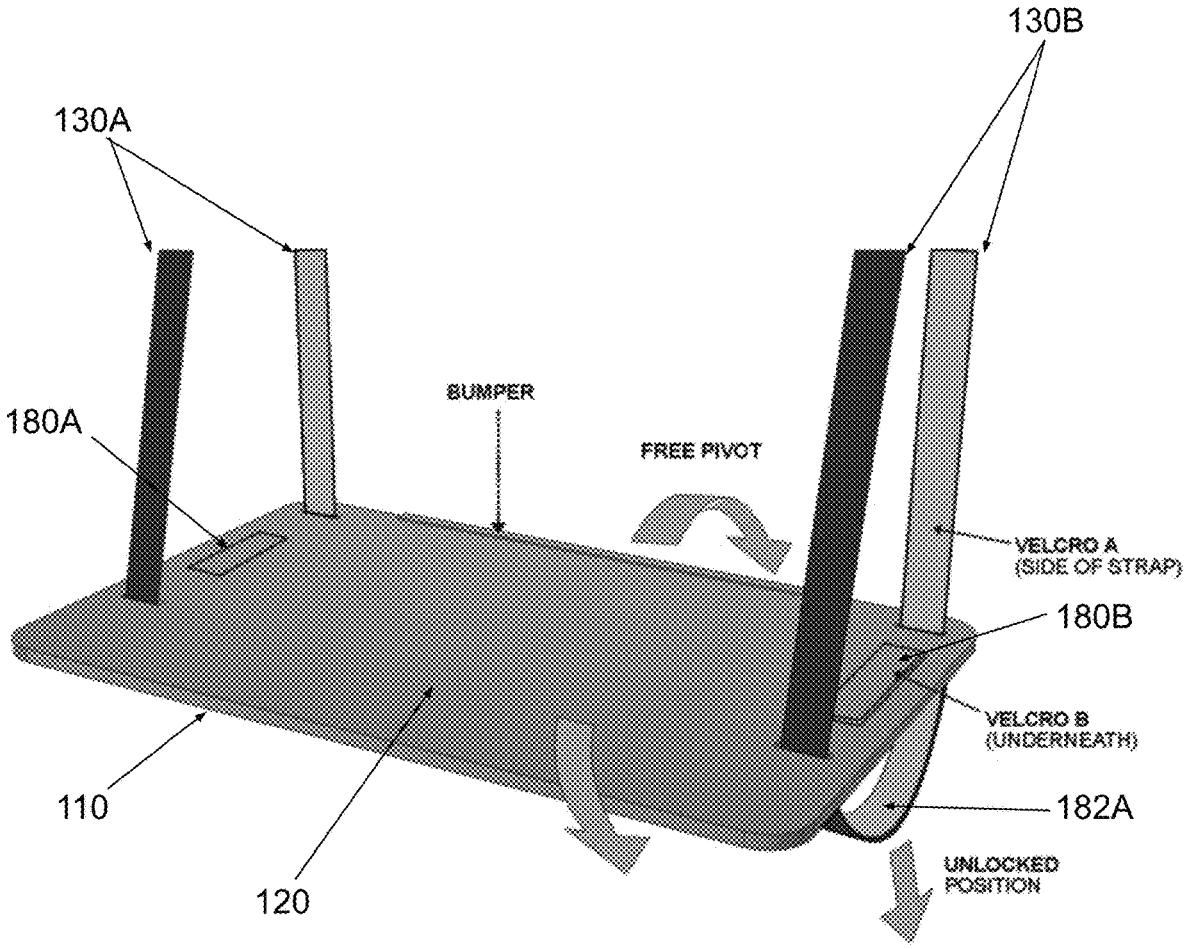
FIG. 4 is an illustration of a top perspective view of a support surface of an activity support device of a preferred embodiment of the present invention, in an unlocked position for adjustment of an angle of the support surface.
Figure 5:
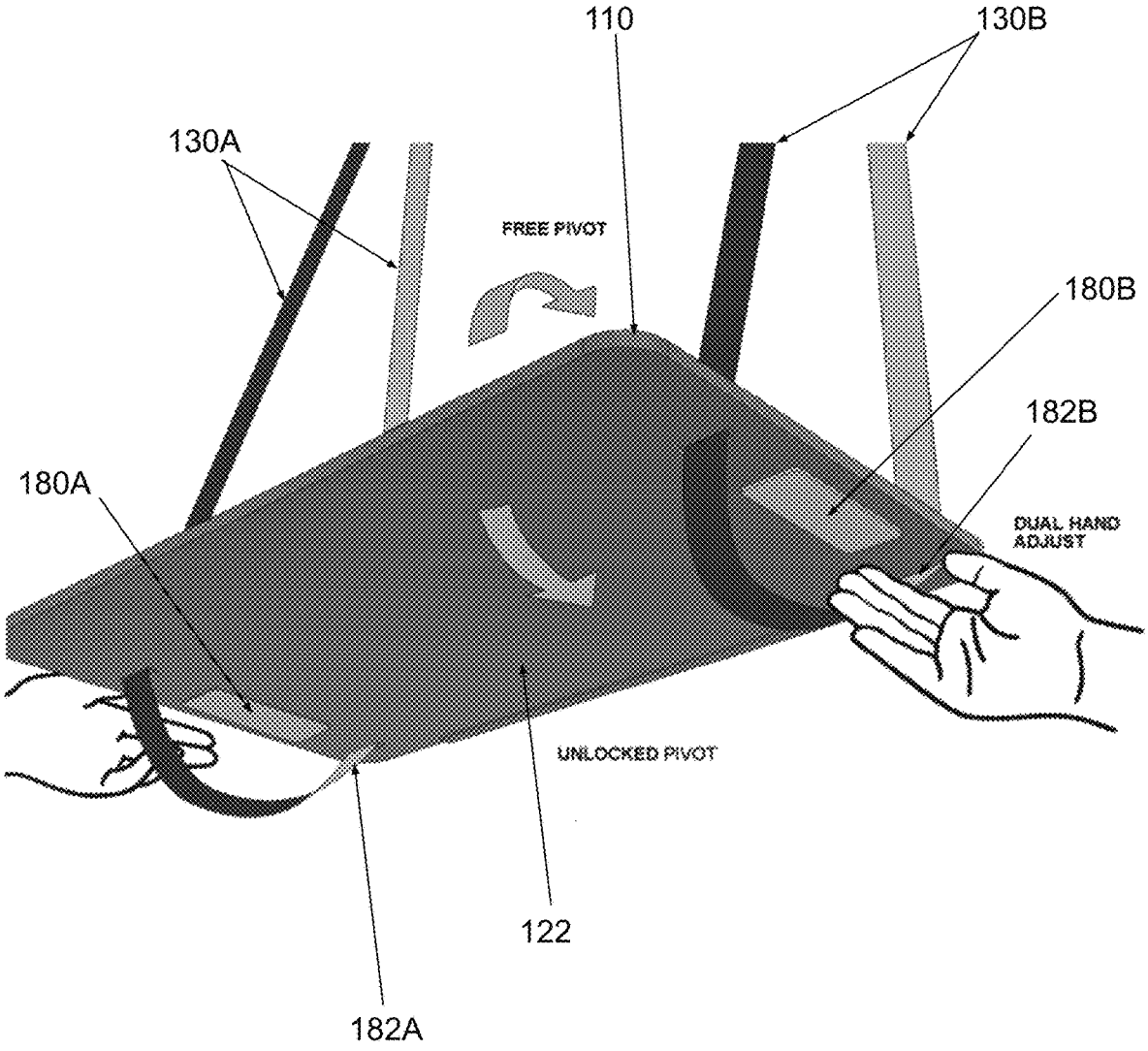
FIG. 5 is an illustration of a bottom perspective view of a support surface of an activity support device of a preferred embodiment of the present invention, in an unlocked position for adjustment of an angle of the support surface.

Preferably, the straps or other support features are secured by a hook (see, e.g., FIGS. 1-3). However, any manner of attachment using any suitable device or feature is contemplated. Other non-limiting examples include nails, suction cups, hook-and-loop (e.g., Velcro) configurations and clips. In some embodiments in which a hook is used, the hook can be formed from any material, such as, for example, metal, wood, plastic, or a flexible material. In some embodiments that are suitable for attachment to a vehicle, plastic hooks can be used to secure the body and/or activity support surface to the top of a vehicle door or window to provide an accessible activity support surface for travelers without damaging the door or window. In some embodiments in which suction cups are used, the suction cups can be suitable for adhering to the glass or plastic of a window. Preferably, the fasteners, or other attachment devices or features, can adjust or be adjusted to accommodate a variety of support surfaces or elements, such as, for example, a variety of door frames, window frames and wall features.

Referring again to FIGS. 1-7 for illustration purposes as to certain example embodiments, in preferred embodiments, each suspender 130A,B is adapted to enable adjustment of a suspension distance of the support surface 120 relative to the support structure 200.

In this regard, and referring now additionally to FIG. 3, preferably, each suspender 130A,B includes a respective suspension connector 150A,B, a respective support strap 132A,B, and a respective strap lock 160A,B, each support strap 132A,B having a respective strap length including a respective connection portion 134A,B, a respective attachment portion 136A,B and a respective locked portion 138A,B, the connection portion 134A,B being secured to the suspension connector 150A,B, each of the attachment portion 136A,B and the locked portion 138A,B being secured to the strap lock 160A,B to form a respective support loop 130A,B between the attachment portion 136A,B and the locked portion 138A,B, each loop 130A,B being integrated with the body 110 as discussed above.

Further preferably, at least one of the attachment portion 136A,B and the locked portion 138A,B are releasably secured to the strap lock 160A,B. In this regard, further preferably, each loop 130A,B has a loop length and the strap lock 160A,B can be unlocked and relocked to enable adjustment of the loop length, and adjustment of the loop length adjusts the suspension distance.

Preferably, the device includes one or more such or other adjustment features. The adjustment features of the device can include but are not limited to height adjustment features that enable the body and/or activity support surface to be set at a range of heights. In some embodiments (see, e.g., FIG. 3), each strap preferably passes through a locking mechanism that can be unlocked to allow the strap to pass through it so that the lengths of the tension-bearing portions of the strap can be adjusted, and then locked to secure the strap at the desired position. More particularly, in certain preferred embodiments (see, e.g., FIGS. 1-7), to create a suspended work station, each strap is looped through both the body and/or activity support surface and an over-the-door hook; the straps cradle and suspend the body and/or activity support surface from above; locking and unlocking the straps enables the user to adjust the lengths of the straps, which adjusts the height of the body and/or activity support surface; hook-and-loop components on the straps and the body can be secured to one another to lock the body and/or activity support surface at the desired height, and at a desired orientation (e.g., flat or at another angle).

The locking mechanism can use compression, tension, or any other force to secure and release the strap. In some embodiments, the strap preferably includes markings or other indicators that provide information, such as, for example, information about heights that are ideal, suitable or recommended for certain purposes, such as, for example, heights for children of different ages sitting at the activity support surface, heights for adults standing at the activity support surface, and heights for elevated storage. The markings or other indicators are preferably attached, sewn or otherwise integrated into or visible on the strap.

In some embodiments, the adjustability is provided by the material of the strap, such as, for example, when the material from which the strap is formed includes rubber or another flexible material. In certain embodiments, the adjustability is provided without mechanisms, assemblies, or moving parts.

In some embodiments, the adjustability is made possible by devices, features or materials attached to, connected to, or otherwise integrated with the material of the strap, such as, for example, hook-and-loop (e.g., Velcro) materials sewn onto parts of the strap (see, e.g., FIGS. 2 and 4-7). These and other configurations preferably enable the locking of the body and/or activity support surface at desired angles, heights, and other orientations (see, e.g., FIGS. 2 and 4-7), by way of one or more movements that are easily executed by persons of any age. In some embodiments, the length of the supporting strap or straps can be adjusted by other fastening materials, mechanisms, or devices, such as, for example, magnets, buckles, buttons and snaps.

Figure 6:
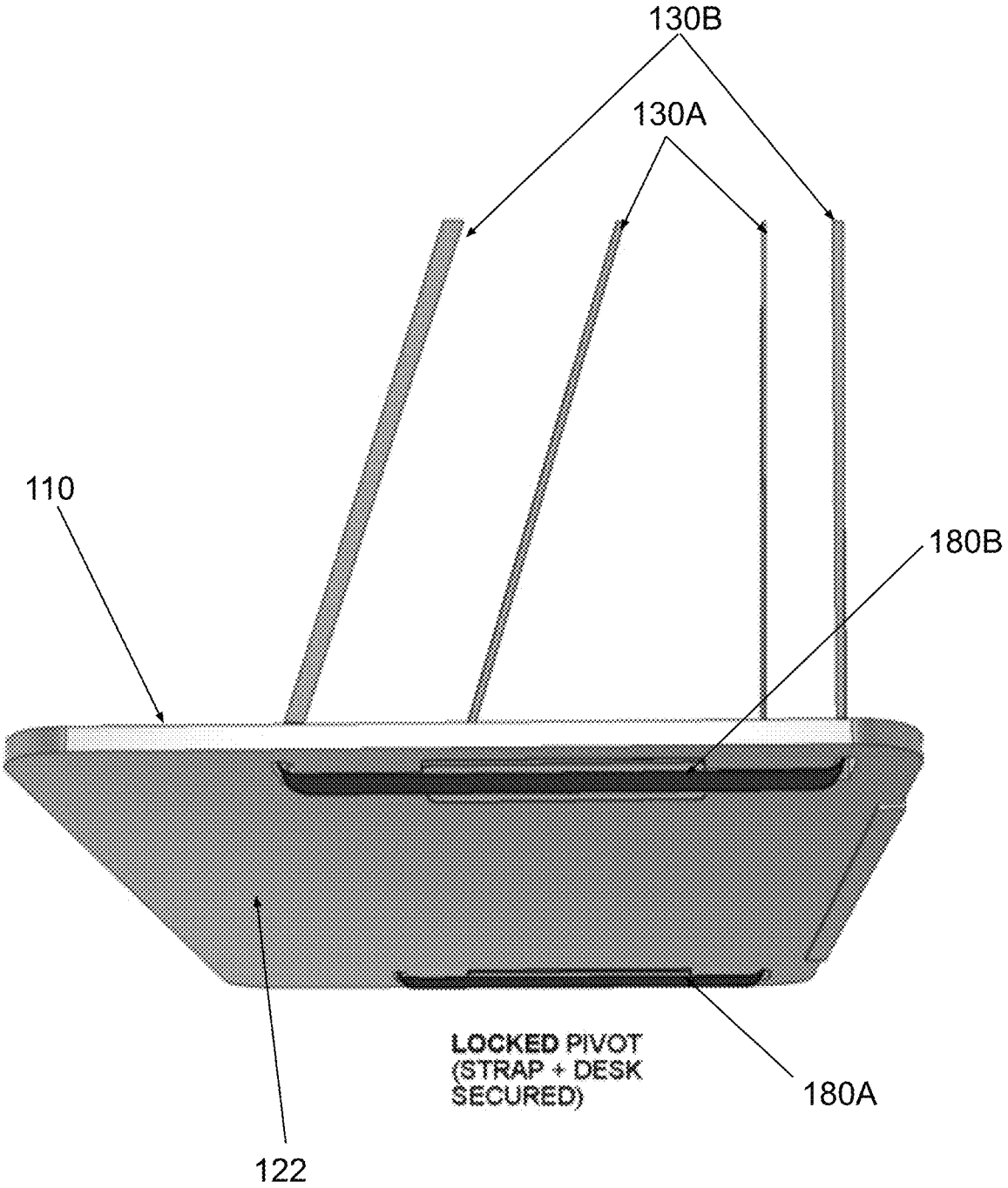
FIG. 6 is an illustration of a side perspective view of a support surface of an activity support device of a preferred embodiment of the present invention, in a locked position at a flat angle of the support surface.
Figure 7:
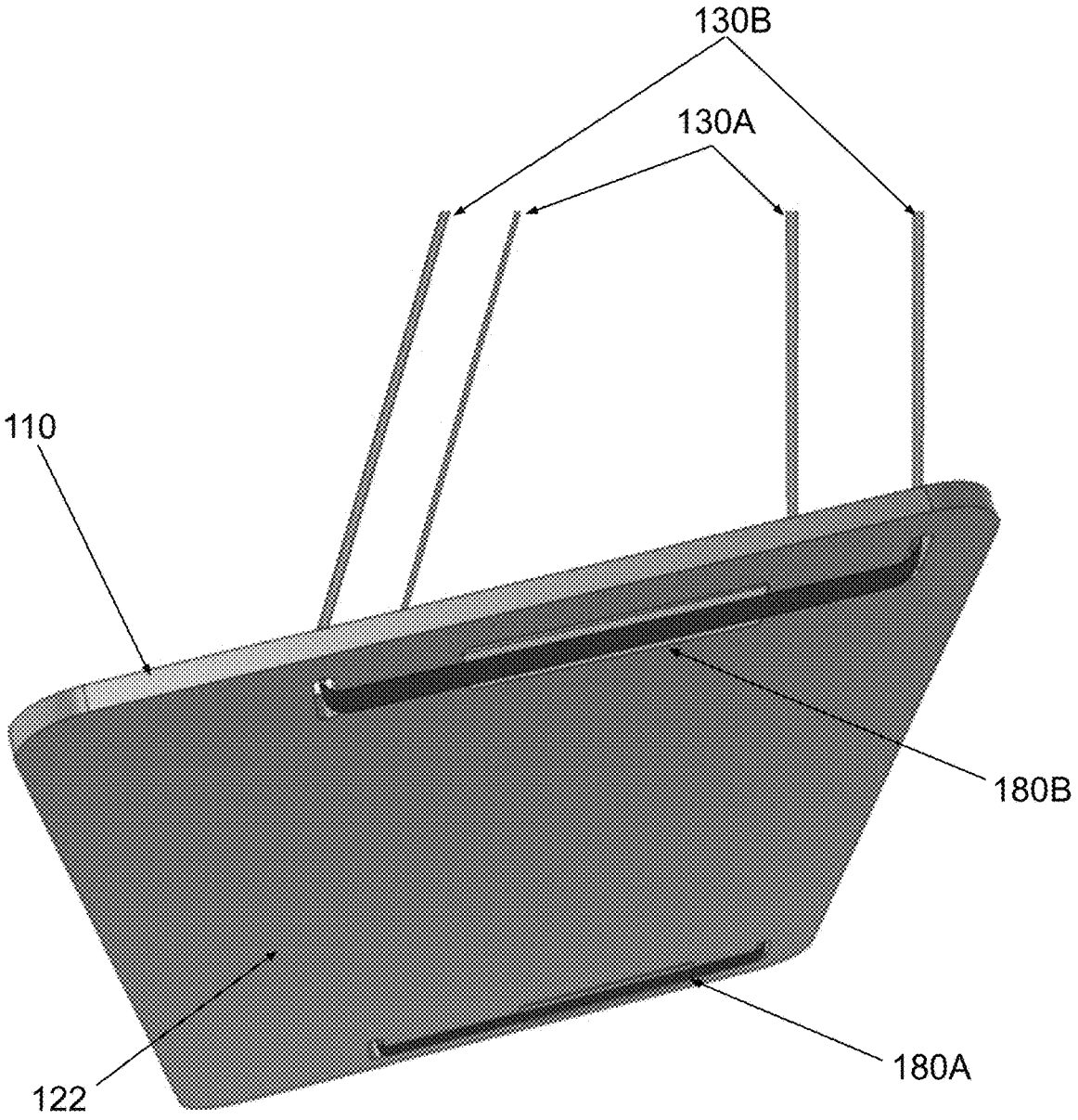
FIG. 7 is an illustration of a side perspective view of a support surface of an activity support device of a preferred embodiment of the present invention, in a locked position at a tilted angle of the support surface.

Referring again to FIGS. 1-7, and now particularly to FIGS. 4-7, for illustration purposes as to certain example embodiments, further preferably, as discussed above, each loop 130A,B has a loop length and each loop 130A,B is releasably secured to the body 110 along the loop length. Still further preferably, the body 110 can be released and resecured to the loop 130,B to enable adjustment of a position of the body 110 relative to the loop 130A,B, and adjusting the position changes the angle of the support surface 120 relative to the support structure 200. Even further preferably, the angle can be adjusted such that the support surface 120 is substantially perpendicular to the support structure 200 (e.g., as illustrated in FIG. 6) at a level operational angle, and the angle can be adjusted such that the support surface 120 is at any other desired operational angle relative to the support structure 200 (e.g., at an angle illustrated in FIG. 7). Still further preferably, as discussed above, the body 110 has at least two through holes 140A, 142A;140B,142B and each loop 130A,B passes through the holes to suspend part of the body 110 by the loop 130A,B.

In preferred embodiments, the device includes one or more such or other space saving features. Preferably, the device uses space that would otherwise have been wasted. For example, the space in front of a door is generally "dead space", or otherwise not usable because, for example, furniture cannot be placed there because then its use as a doorway would be blocked. Also, for example, other areas of a room may be "dead space" or otherwise unusable as a practical matter due to being too small or strangely shaped. Further, preferably, the device avoids the need to use furniture that requires ground supports (e.g., legs, feet, casters, etc.) and that consequently sacrifices floor space.

The space saving features of the present invention include but are not limited to enabling the body and/or activity support surface to be folded toward and away from (or otherwise moved relative to) the support structure (e.g., door, wall, window, or other vertical surface), such that it can be placed in a stowed position (e.g., substantially flat against or parallel to the support structure) and an operating position (e.g., substantially perpendicular or at another angle relative to the support structure) (see, e.g., FIG. 2).

In certain embodiments, in the stowed position, the body and/or activity support surface is flat against or parallel to a door, wall, or window from which it is suspended, and in the operating position, the body and/or activity support surface extends substantially perpendicular to, or at a useful work angle from, the door, wall, or window from which it is suspended (see, e.g., FIGS. 1-2). Accordingly, when the body and/or activity support surface is deployed in the operating position, it preferably can be used as an activity support surface, and when the body and/or activity support surface is stowed, it preferably allows for the resulting reclaimed space to be open, to avoid congestion, or to be used for other activities or movements. The stowed position further preferably allows the underside of the body and/or activity support surface to be used for purposes suited to the enhanced visibility of the underside when the body and/or activity support surface is stowed. For example, the underside of the body and/or activity support surface can be used as a bulletin board, magnetic board, cork board, view screen, touch screen, chalk board, or dry erase board.

The stowed position further preferably allows for storage of frequently used objects, or other objects, on the underside of the body and/or activity support surface, and such objects preferably can be secured in stored positions by pouches (see, e.g., FIGS. 1-2), boxes, or other compartments or enclosures, or by attachment features, such as, for example, straps, anti-slip bars, hook-and-loop (e.g., Velcro) configurations, and clips.

In preferred embodiments, securing of the body and/or activity support surface in the stowed position is made possible by attachment features (such as, for example, hook-and-loop (e.g., Velcro) configurations, magnets, and snaps) located at specific positions on the device. More particularly, for example, in certain preferred embodiments (see, e.g., FIGS. 1-3), the straps can be unlocked from their supports at or near the top of the door, wall, or window, then pulled through the supports until the body and/or activity support surface pivots toward the door, wall, or window, enough to rest flat against the door, wall, or window; the straps can then again be locked to the supports, to keep the body and/or activity support surface in this stowed position.

In certain embodiments having straps for hanging the body and/or activity support surface, and hook-and-loop (e.g., Velcro) configurations integrated with the straps for securing the body and/or activity support surface in the stowed position, the device is lightweight as well as cost-efficient due to the minimal number of parts and the simplicity of operation, and accordingly features a simple, versatile design that can be easily used by persons of any age.

Accessory Facilitation Features

Referring again to FIGS. 1-7, and now particularly to FIGS. 1-3, for illustration purposes as to certain example embodiments, as discussed in certain respects above, in preferred embodiments, the activity support device 100 further includes an accessory facilitation feature 170. In FIGS. 1-2, the accessory facilitation feature 170 is shown as a storage feature 170 (e.g., zippered pouch 170) hanging from each loop 130A,B below the body 110. However, additional and/or alternate accessory facilitation features can include one or more of another storage feature, a cable management feature, anti-slip features, a magnetic surface, and a coated surface adapted for eraseable writing.

In preferred embodiments, the underside of the body and/or activity support surface can be utilized both when the body and/or activity support surface is deployed in its operational orientation (e.g., substantially perpendicular or otherwise desirably angled relative to the support structure) as well as when the body and/or activity support surface is stowed in its closed orientation (e.g., substantially parallel to or otherwise against or adjacent the support structure). Therefore, in some of such embodiments, it is preferred that the device include one or more storage features at the underside of the body and/or activity support surface, such as, for example, storage recesses, pouches (see, e.g., FIGS. 1-2), or enclosures. The storage features preferably are suitable for containing activity related accessories, or other accessories. Examples of accessories include but are not limited to pencils, crayons and craft items (e.g., for kids;); headphones, electronic peripherals and computer accessories (e.g., for adults); and medical supplies, supplements and reminder notes (e.g., for the elderly). In some embodiments, the storage features include but are not limited to nylon pouches with zippers (see, e.g., FIGS. 1-2).

Preferably, the storage features are configured to efficiently store desired items without interference with the activity support surface (e.g., the top side of the body) but in a manner permitting easy and instant access to the stored items when the activity support surface is in operational use. As an example, papers and files can be organized below the body and/or activity support surface so that they are immediately accessible when the body and/or activity support surface is deployed, and stored with the body and/or activity support surface when it is stowed.

Preferably, the underside of the body and/or activity support surface is coated or otherwise manufactured to have a surface on which writings and drawings can be written (and preferably erased), so that, for example, when the body and/or activity support surface is stowed, the underside of the body and/or activity support surface can be used as a message board. Accordingly, writing instruments (such as, for example, markers, pens or chalk) can be used to write messages on the underside of the body and/or activity support surface. In some embodiments, the surface of the underside is additionally or alternatively magnetic, so that, for example, magnetic attachment devices can be used to attach papers, photos, and other message items to the underside of the body and/or activity support surface.

Operation and Methods of Use

In operation, and referring again to FIGS. 1-7 for illustration purposes as to certain example embodiments, preferably, each suspension connector 150A,B is connected to the support structure 200 (e.g., by hooking each hook 152A,B over a top of the door 200), and accordingly each strap 132A,B hangs from a respective suspension connector 150A,B at the connection portion 134A,B of the strap 132A,B. Then each strap 132A,B, passing from the attachment portion 136A,B down through the first through hole 140A,B then up through the second through hole 142A,B and then up through the strap lock 160A,B to be locked in the strap lock 160A,B at the locking portion 138A,B, forms a support loop 130A,B from which the body 110 is suspended.

When it is desirable for the support surface to be used for an activity, the support surface 120 can be placed at any desired operational angle by detaching the hook-and-loop features 180A,182A;180B,182B from one another, moving the body 110 along the length of the support loops 130A,B to move the position of the body 110 relative to the support loops 130A,B until the support surface 120 is at a desired angle, and then reattaching the hook-and-loop features 180A,182A;180B,182B to one another.

Engagement in an activity using the support surface 120 is then possible as weight applied to the support surface 120 is supported by the support loops 120A,B as they are connected to the support structure 200 by the support connectors 150A,B.

When it is desirable for the support surface to be stowed against the support structure 200 to free up the space otherwise occupied by the support surface 120 when at the operational angle, the support surface 120 can be placed into a stowed position by detaching the hook-and-loop features 180A,182A;180B,182B from one another, moving the body 110 along the length of the support loops 130A,B to move the position of the body 110 relative to the support loops 130A,B until the support surface 120 is parallel to the support structure 200, and then reattaching the hook-and-loop features 180A,182A;180B,182B to one another.

In preferred embodiments, the device is configured for portability. In some embodiments, the device is configured for portability by the body and/or activity support surface being dimensioned similarly to the size of a messenger bag, laptop sleeve, or other carrying bags. In some embodiments, the body and/or activity support surface is dimensioned to fit inside one or more of such carrying bags. In some embodiments in which straps are used to support the body and/or activity support surface, the straps can additionally be used as shoulder straps or other handles to facilitate carrying of the body and/or activity support surface.

Preferably, components of the device other than the body can be rolled, folded, or otherwise made compact, and secured in such a configuration so as to provide the device with a flat profile for transport. Further preferably, the device is made lightweight due to the minimal number of components and the materials from which the components are made.

Accordingly, preferably, the body, straps, and hooks can fit into a travel tote, case, or other device for carrying. For example, the body can either fit into a sleeve, pocket, or recess, or be folded one or more times to fit into a sleeve, pocket, or recess. Further, for example, the straps can be rolled, folded, or otherwise made compact, and stored in a sleeve, pocket, or recess. Further, for example, the hooks can be straightened or folded or otherwise be made flat or compact, and stored in a sleeve, pocket, or recess. Other components can also be made compact and stored in a sleeve, pocket, or recess.

Further in preferred embodiments, the device is configured for portability due to the ease of deploying the body (e.g., from its compact, transport configuration) and the ease of packing the body (e.g., into its compact, transport configuration). Preferably, only a few simple movements are required to hang the body and/or activity support surface from a door frame, or otherwise support the body and/or activity support surface on a desired surface, to provide a standing desk (e.g., if the height of the body and/or activity support surface is set to be suitable for a standing user) or other place for work.

Further in preferred embodiments, once the body and/or activity support surface is deployed, or during deployment of the body and/or activity support surface, adjustment devices and features can be used to adjust the height of the work surface. For example, in certain embodiments, integrated hook-and-loop (e.g., Velcro) configurations can be manipulated to adjust the height of the work surface (see, e.g., FIGS. 4-7).

Further in preferred embodiments, the device includes organizational or storage features, such as, for example, cable management features and features for storing activity tools and other accessories. For example, these features can be built into or attached to the body and/or activity support surface itself, integrated into straps, or otherwise be made part of the experience of using the device.

Preferably, in embodiments in which the body and/or activity support surface is substantially horizontal when deployed, the body and/or activity support surface can be used, for example, as a desk, food preparation surface, play table, or activity support area, without requiring floor space for support.

Preferably, in embodiments in which the height and other aspects of the body and/or activity support surface placement or orientation can be adjusted easily with one or a few simple movements, certain ergonomic benefits are enjoyed. For example, such aspects can be adjusted throughout the day to provide a variety of orientations, in accordance with recommendations made by ergonomic experts. Preferably, any desired angle can be chosen and secured with one or a few simple actions, such as, for example, a twist of the body and/or activity support surface and corresponding reconfiguration of integrated hook-and-loop (e.g., Velcro) features on the hanging straps, to secure the revised orientation of the body and/or activity support surface. The multiple adjustment and customization options for the suspended body and/or activity support surface of preferred embodiments of the invention accordingly provide a space-saving but ergonomically beneficial portable activity support surface.

Further preferably, when additional space in a room is needed (or if, for example, a door from which the body and/or activity support surface is suspended needs to be moved), the body and/or activity support surface can be easily "flipped up" and secured against the door or other support surface from which it is suspended (see, e.g., FIGS. 1-2). In certain embodiments, the cooperating use of straps with integrated hook-and-loop (e.g., Velcro) features enables the unlocking of the body and/or activity support surface from the horizontal operational position and the securing of the body and/or activity support surface in the vertical space saving position. In certain embodiments, in such an orientation, the device is compact against the door (e.g., similar to a picture hanging on a wall) and effectively "disappears" from the room, opening up the room to be used in different ways with the benefit of additional space (see, e.g., FIGS. 1-2).

Further preferably, the body and/or activity support surface can be dual-purpose, in that when the body and/or activity support surface is stowed against its support surface (e.g., a door), the underside of the body and/or activity support surface can be utilized as a message board, or utilized for storage or organization. In certain embodiments in which the body and/or activity support surface is made from plastic, writing instruments (such as, for example, dry erase markers) can be used for writing messages on the underside of the body and/or activity support surface (and, for example, associated erasers can be used for erasing messages from the underside of the body and/or activity support surface), or Post-It notes can be attached to and removed from the underside of the body and/or activity support surface.

As some examples, children who are using the activity support surface for play or craft activities can quickly organize any messes, and adults can quickly change the space from a home office back to a bedroom. As another example, in some embodiments in which the body and/or activity support surface is plastic, the device can be used in a kitchen for food preparation, then be wiped clean, then converted to its space saving orientation for the underside to become a message board on which a family can share important notes.

As needs increase for home spaces to be converted into work spaces, the device of the invention preferably enables the quick and easy transformation of any room from being suitable for one type of use to being suitable for another type of use, by providing a portable, adjustable, "pop-up" activity support surface that can be suspended above the floor without claiming any floor space, and collapsed against the wall without requiring any more wall space than would a picture. The device of the invention accordingly preferably provides the flexibility to enable a person of any age group to quickly initiate work and quickly put work away, without help, tools or additional hardware, and with minimal impact to existing space, furniture or other activities.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. An activity support device, comprising:

a body having at least one activity support surface and an underside opposite the support surface; and at least one suspender integrated with the body and adapted to suspend the body from a support structure, the suspender including a support loop having a length; wherein integration of the suspender with the body enables adjustment of an angle of the support surface relative to the support structure, and the body can be released and resecured to the support loop at the underside.

2. The device of claim 1, wherein the support loop is releasably secured to the body along the length.

3. The device of claim 1, wherein the body can be released and resecured to the support loop to enable adjustment of a position of the body relative to the support loop, and adjusting the position changes the angle of the support surface relative to the support structure.

4. The device of claim 1, wherein the angle can be adjusted such that the support surface is substantially parallel to the support structure.

5. The device of claim 1, wherein the body has at least two through holes and the support loop passes through the holes to suspend the body by the support loop.

6. The device of claim 5, wherein the support loop passes through a first through hole from the support surface to the underside and through a second through hole from the underside to the support surface.

7. The device of claim 1, further comprising an accessory facilitation feature including one or more of a storage feature, a cable management feature, anti-slip features, a magnetic surface, and a coated surface adapted for writing.

8. The device of claim 1, wherein the body can be released and resecured to the support loop at the underside by corresponding hook-and-loop features on the underside and the support loop.

9. The device of claim 1, wherein the suspender includes a suspension connector secured to the support loop along the length, the suspension connector adapted to connect to the support structure.

10. The device of claim 9, wherein the support structure is a door and the suspension connector includes a hook that hooks onto a top of the door.

11. An activity support device, comprising:

a body having at least one activity support surface; and at least one suspender integrated with the body and adapted to suspend the body from a support structure; wherein integration of the suspender with the body enables adjustment of an angle of the support surface relative to the support structure, the suspender is adapted to enable adjustment of a suspension distance of the support surface relative to the support structure, and the suspender includes a suspension connector, a support strap, and a strap lock for locking the support strap at a desired strap length, the strap lock including one or more of a magnet, a buckle, a button and a snap.

12. The device of claim 11, further comprising an accessory facilitation feature including one or more of a cable management feature, anti-slip features, a magnetic surface, and a coated surface adapted for writing.

13. The device of claim 12, wherein the body has an underside opposite the support surface and the accessory facilitation feature is on the underside of the body.

14. An activity support device, comprising:

a body having at least one activity support surface; and at least one suspender integrated with the body and adapted to suspend the body from a support structure; wherein integration of the suspender with the body enables adjustment of an angle of the support surface relative to the support structure, the suspender is adapted to enable adjustment of a suspension distance of the support surface relative to the support structure, and the suspender includes a suspension connector, a support strap, and a strap lock, the support strap having a strap length including a connection portion, an attachment portion and a locked portion, the connection portion being secured to the suspension connector, each of the attachment portion and the locked portion being secured to the strap lock to form a support loop between the attachment portion and the locked portion, the support loop being integrated with the body.

15. The device of claim 14, wherein at least one of the attachment portion and the locked portion are releasably secured to the strap lock.

16. The device of claim 14, wherein the support loop has a loop length and the strap lock can be unlocked and relocked to enable adjustment of the loop length, and adjustment of the loop length adjusts the suspension distance.

17. The device of claim 14, wherein the support loop has a loop length and the support loop is releasably secured to the body along the loop length.

18. The device of claim 17, wherein the body can be released and resecured to the support loop to enable adjustment of a position of the body relative to the support loop, and adjusting the position changes the angle of the support surface relative to the support structure.

19. The device of claim 18, wherein the angle can be adjusted such that the support surface is substantially perpendicular to the support structure, and the angle can be adjusted such that the support surface is substantially parallel to the support structure.

20. The device of claim 17, wherein the body has at least two through holes and the support loop passes through the holes to suspend the body by the support loop.

* * * * *